US009339098B2

(12) United States Patent
Takata et al.

(10) Patent No.: US 9,339,098 B2
(45) Date of Patent: May 17, 2016

(54) MASCARA APPLICATOR

(71) Applicants: SHISEIDO COMPANY, LTD., Chuo-ku, Tokyo (JP); FIGLA COMPANY, LTD., Chiyoda-ku, Tokyo (JP)

(72) Inventors: Motoki Takata, Yokohama (JP); Takashi Tajima, Tokyo (JP)

(73) Assignees: SHISEIDO COMPANY, LTD., Tokyo (JP); FIGLA COMPANY, LTD., Tokyo (JP)

( * ) Notice: Subject to any disclaimer, the term of this patent is extended or adjusted under 35 U.S.C. 154(b) by 0 days.

(21) Appl. No.: 14/361,590

(22) PCT Filed: Dec. 5, 2012

(86) PCT No.: PCT/JP2012/081571

§ 371 (c)(1),
(2) Date: Sep. 19, 2014

(87) PCT Pub. No.: WO2013/084964

PCT Pub. Date: Jun. 13, 2013

(65) Prior Publication Data

US 2015/0020835 A1 Jan. 22, 2015

(30) Foreign Application Priority Data

Dec. 6, 2011 (JP) ..... 2011-266372

(51) Int. Cl.
*A45D 40/26* (2006.01)
*A45D 34/04* (2006.01)
*A46B 5/00* (2006.01)

(52) U.S. Cl.
CPC ..... *A45D 40/265* (2013.01); *A45D 34/045* (2013.01); *A46B 5/0075* (2013.01); *A46B 2200/1053* (2013.01)

(58) Field of Classification Search
CPC ... A45D 40/265; A45D 40/26; A45D 40/262; A45D 40/264; A45D 34/04; A45D 34/042; A45D 34/043; A45D 34/045; A46B 5/0075; A46B 5/002; A46B 5/0054; A46B 5/0058; A46B 5/0079; A46B 5/0083; A46B 5/0087; A46B 5/0062; A46B 2200/1053; A46B 2200/1046; A46B 9/021; A46B 9/026; A46B 9/028; A46B 5/0041; A46B 9/023; B25G 3/38; B25G 1/06
USPC ..... 132/218, 216, 212, 200, 317, 318, 320; 16/224; 433/109, 157; 401/129; 604/310, 47
See application file for complete search history.

(56) References Cited

U.S. PATENT DOCUMENTS 2,749,567 A * 6/1956 Krueger ..... 15/172
3,714,678 A * 2/1973 Weisz et al. ..... 16/224

(Continued)

FOREIGN PATENT DOCUMENTS

CN 201743166 U 2/2011
EP 1917883 A2 * 5/2008 ..... A45D 40/265

(Continued)

OTHER PUBLICATIONS

Extended European Search Report dated Oct. 9, 2015 issued in the corresponding European patent application No. 12855259.3.

(Continued)

*Primary Examiner* — Robyn Doan
*Assistant Examiner* — Tatiana Nobrega
(74) *Attorney, Agent, or Firm* — Rankin, Hill & Clark LLP

(57) ABSTRACT

A mascara applicator includes an application stick that is attached to a cap sealing and covering an opening part of a mascara accommodation container and that can be accommodated in the mascara accommodation container, and an application body that is rotatably attached to a tip end of the application stick and that extends in a substantially axial direction of the application stick, in which one side surface on a side opposite to a rotating direction of the application body is orthogonal to a plane including a rotation path, and a ridge part that is formed by the one side surface and a side surface adjacent to the one side surface is used, while the application body is rotated and an axis of the application body is bent with respect to an axis of the application stick, so as to apply mascara.

7 Claims, 13 Drawing Sheets

(56) References Cited

U.S. PATENT DOCUMENTS

| | | | | |
|---|---|---|---|---|
| 4,165,755 | A * | 8/1979 | Cassai | 132/218 |
| 4,370,989 | A * | 2/1983 | Taylor | 132/317 |
| 4,428,388 | A * | 1/1984 | Cassai | A46B 9/021 132/218 |
| 5,137,038 | A * | 8/1992 | Kingsford | 132/218 |
| 5,377,377 | A * | 1/1995 | Bredall et al. | 15/167.1 |
| 6,026,823 | A * | 2/2000 | Gueret | 132/218 |
| 6,309,125 | B1 * | 10/2001 | Peters | 401/127 |
| 6,413,087 | B1 * | 7/2002 | Petrich et al. | 433/89 |
| 7,172,357 | B2 * | 2/2007 | Gueret | 401/129 |
| 7,429,141 | B2 * | 9/2008 | Habatjou | 401/127 |
| 7,823,593 | B2 * | 11/2010 | Gueret | 132/218 |
| 7,866,327 | B1 * | 1/2011 | Gueret | 132/218 |
| 8,454,097 | B2 * | 6/2013 | Gueret | 300/21 |
| 8,568,048 | B2 * | 10/2013 | Chan | 401/127 |
| 2004/0134507 | A1 * | 7/2004 | Gueret | 132/218 |
| 2007/0025803 | A1 * | 2/2007 | Dieudonat | A45D 40/265 401/127 |
| 2007/0067935 | A1 * | 3/2007 | Lin et al. | 15/229.6 |
| 2007/0086829 | A1 * | 4/2007 | Henrikson | 401/129 |
| 2010/0050358 | A1 * | 3/2010 | Kim | 15/167.2 |
| 2010/0319720 | A1 * | 12/2010 | Thorne et al. | 132/218 |
| 2011/0135376 | A1 * | 6/2011 | Weigel et al. | 401/29 |
| 2011/0176856 | A1 * | 7/2011 | Gardner | A45D 40/265 401/195 |
| 2012/0195672 | A1 * | 8/2012 | Chan | A45D 40/265 401/129 |
| 2014/0016984 | A1 * | 1/2014 | Kim | 401/129 |
| 2014/0109928 | A1 * | 4/2014 | Simard | 132/200 |
| 2015/0010340 | A1 * | 1/2015 | Gueret | 401/129 |
| 2015/0020836 | A1 * | 1/2015 | Ramet | A45D 34/045 132/200 |
| 2015/0164210 | A1 * | 6/2015 | Lou | A46B 9/021 401/129 |

FOREIGN PATENT DOCUMENTS

| | | | |
|---|---|---|---|
| EP | 2229839 | A2 | 9/2010 |
| EP | 2329742 | A1 | 6/2011 |
| FR | 2605505 | A1 | 4/1988 |
| JP | 6012314 | | 1/1985 |
| JP | 9182615 | A2 | 7/1997 |
| JP | 1099127 | | 4/1998 |
| JP | 2004049712 | A2 | 2/2004 |
| JP | 2005237395 | A2 | 9/2005 |
| JP | 2008114071 | A2 | 5/2008 |
| KR | 20110005581 | | 6/2011 |
| KR | 20110107224 | A * | 9/2011 |

OTHER PUBLICATIONS

Japanese Office Action dated Jan. 29, 2013 issued in the corresponding Japanese patent application No. 2011-266372 and English translation thereof.

* cited by examiner

The mascara applicator according to the present invention (a)

The conventional mascara applicator (b)

MASCARA APPLICATOR

TECHNICAL FIELD

The present invention relates to a mascara applicator for applying mascara on eyelashes.

BACKGROUND ART

Conventionally, application of mascara on eyelashes has been important in eye makeup, and mascara applicators have been one of significant makeup tools that control eye makeup finish.

The general mascara applicator is configured in such a manner that an application stick is attached to the inside of a cap that is screwed to a mouth part of a container body housing the mascara therein, and an application body that is formed by sandwiching brush fibers by a plurality of wires is fixed to the tip end of the application stick (FIG. 11). When it is in use, the cap is held, the application stick is kept horizontally, and the application body is brought into contact with the eyelashes, so as to apply the mascara stuck on the brush fibers on the eyelashes. Upon applying the mascara, the brush is operated while looking at the eyes reflected in the mirror and checking one's makeup operation.

With such a mascara applicator, however, the application stick that is kept horizontally or a hand holding the cap blocks a visual field and, when the makeup is applied on the eyelashes of both eyes, it is necessary to switch between the right and left hands for holding the cap, and to perform detailed makeup operation by the hand opposite to a dominant hand, which causes difficulty in the makeup operation. Further, it is necessary to hold the cap and keep the elbow high in order to keep the brush horizontally. Thus, the position of the brush becomes unstable, and cautions are required and mistakes are often caused in bringing the brush into contact with the eyelashes appropriately.

Furthermore, with the general mascara applicator, the application body has a columnar shape, and therefore, the application body cannot be brought into contact securely with the roots of the eyelashes. This makes it difficult to apply the mascara to the roots of the eyelashes, and to curl the eyelashes effectively.

Patent document 1: Japanese Patent Application Publication No. 2004-49712

DISCLOSURE OF THE INVENTION

An object of the present invention is to provide a mascara applicator that can be used for makeup operation at the time of applying makeup on eyelashes of both eyes, by using one's dominant hand, without the need of switching between the right and left hands for holding a brush in order to secure a visual field, that allows its brush to be kept horizontally with ease, and that provides excellent makeup finish.

As a result of the study made by the present inventors in order to solve the above-described problems, the inventors have found out that the mascara can be applied stably and the makeup finish is excellent when an application body of a mascara applicator that is rotatably attached to a tip end of a applicator stick has one side surface that is on a side opposite to a rotating direction and that is orthogonal to a plane including a rotation path, and when the mascara is applied by using a ridge part that is formed by the one side surface and a side surface adjacent to the one side surface, while the application body is rotated and is bent with respect to the application stick. Thus, the present invention has been completed.

Namely, the present invention is a mascara applicator including an application stick that is attached to a cap sealing and covering an opening part of a mascara accommodation container and that can be accommodated in the mascara accommodation container, and an application body that is rotatably attached to a tip end of the application stick and that extends in a substantially axial direction of the application stick, in which one side surface on a side opposite to a rotating direction of the application body is orthogonal to a plane including a rotation path, and a ridge part that is formed by the one side surface and a side surface adjacent to the one side surface is used, while the application body is rotated and an axis of the application body is bent with respect to an axis of the application stick, so as to apply mascara.

Further, the present invention is the mascara applicator in which the application body is rotated and bent so that the axis of the application body and the axis of the application stick form a right angle.

Furthermore, the present invention is the mascara applicator in which an angle formed by the two side surfaces that form the ridge part is an acute angle.

Further, the present invention is the mascara applicator in which the application body has a polygonal prism shape that extends in the substantially axial direction of the application stick.

Furthermore, the present invention is the mascara applicator in which the application body has a triangular prism shape or a quadrangular prism shape that extends in the substantially axial direction of the application stick.

Further, the present invention is the mascara applicator in which a bottomed outer cylindrical member is mounted at the tip end of the application stick, coaxially with the application stick, a ball joint that joins with a shaft body supporting the application body, an abutting member that abuts against a surface of the ball joint on the application stick side, and a spring that biases the abutting member against the ball joint are provided in a space that is formed by an inner surface of the outer cylindrical member and an outer surface of the application stick, and the application body is made rotatable by allowing the shaft body supporting the application body to pierce through an insertion hole that is provided at a bottom of the outer cylindrical member.

Furthermore, the present invention is the mascara applicator in which plane parts perpendicular to a turning axis of the ball joint that turns as a result of rotation of the application body are provided on an inner surface of the outer cylindrical member and on an outer surface of the ball joint, so as to limit the rotating direction of the application body by allowing the plane parts to abut against each other.

Further, the present invention is the mascara applicator in which the application body is formed by trimming fibers that are sandwiched between and fixed to a part of twisted wires, and the twisted wires, extending from the application body, are joined to the ball joint as the shaft body.

Furthermore, the present invention is a makeup method including applying mascara in use of a ridge part of the above-described mascara applicator, by rotating an application body and bending an axis of the application body with respect to an axis of an application stick.

With the mascara applicator according to the present invention, the mascara can be applied on the eyelashes by rotating the application body and bending the axis of the application body with respect to the axis of the application stick. Thus, the visual field is not blocked by the hand holding the cap. Further, it is not necessary to switch between the right and left hands for holding the cap even when the makeup is applied on the eyelashes of both eyes. Therefore, the mascara can be applied on the right and left eyelashes by using one's dominant hand, so that the makeup operation can be carried out smoothly.

When the application body is rotated and the axis of the application body is bent with respect to the axis of the application stick, the mascara can be applied by using the ridge part that is formed by one side surface of the application body orthogonal to a plane including a rotation path and a side surface adjacent to the one side surface. This makes it possible to apply the mascara from the roots of the eyelashes while keeping the elbow down, to curl the eyelashes effectively, and to provide excellent makeup finish.

BRIEF DESCRIPTION OF THE DRAWINGS

(FIG. 7(A) illustrates a third embodiment, FIG. 7(B) illustrates a fourth embodiment, and FIG. 7(C) illustrates a fifth embodiment);

BEST MODE FOR CARRYING OUT THE INVENTION

Hereinafter, a mascara applicator according to the present invention will be explained in detail.

Figure 1:
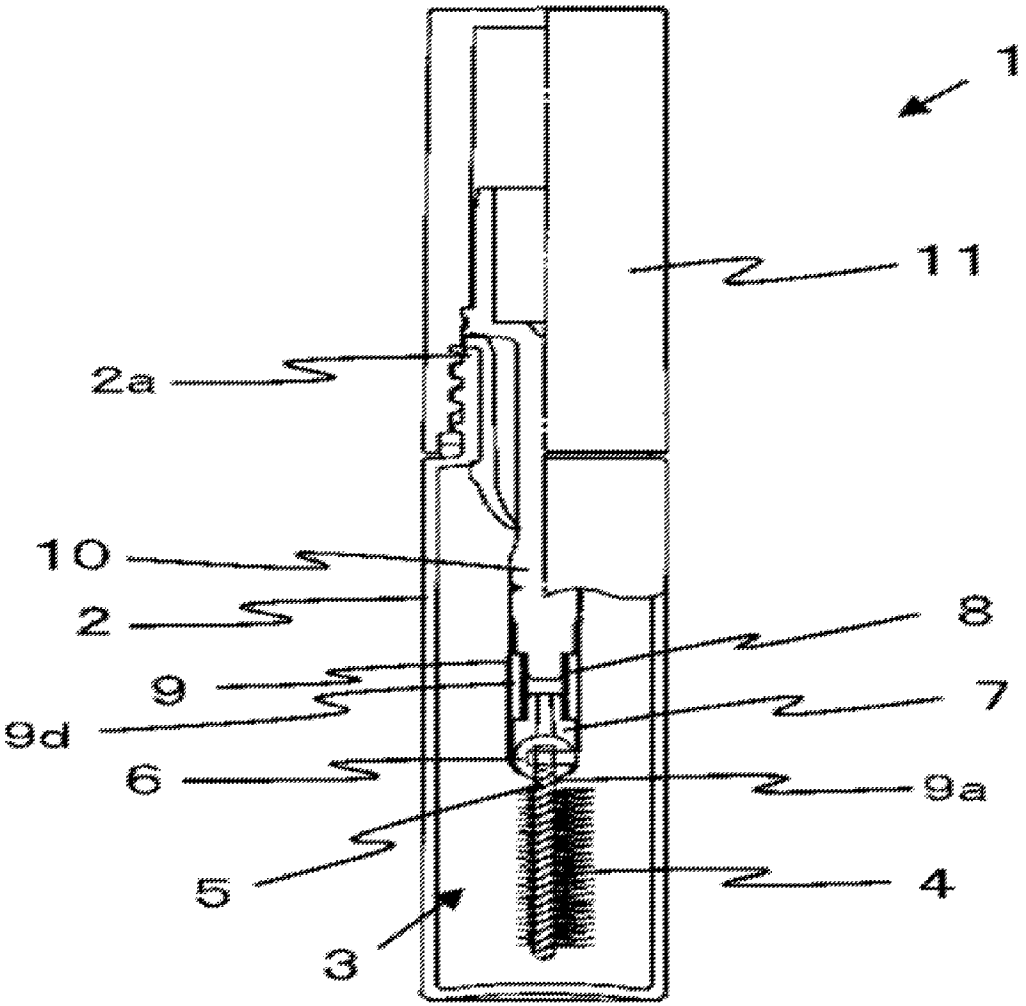
FIG. 1 is an overall view of a mascara container (partial perspective view)

As illustrated in FIG. 1, a mascara applicator (3) is provided with a cap (11) that seals and covers an opening part (2*a*) of a mascara accommodation container (2), an application stick (10) that is attached to the cap (11) and that can be accommodated in the mascara accommodation container (2), and an application body (4) that is rotatably attached to the tip end of the application stick (10) and that extends in a substantially axial direction of the application stick (10).

With thus-configured mascara applicator (3), the application body (4), when not in use, can be arranged substantially coaxially with the application stick (10) and can be inserted in the mascara accommodation container (2) having a bottomed cylindrical shape for accommodation. When it is in use, the application body (4) is rotated by a user and bent at an arbitrary angle with respect to the application stick (10), so as to apply mascara.

At the tip end of the application stick (10), an outer cylindrical member (9) is mounted coaxially with the application stick (10). Inside a space (9*d*) that is formed by the inner surface of the outer cylindrical member (9) and the outer surface of the application stick (10), a ball joint (6) that joins with a shaft body (5) supporting the application body, an abutting member (7) that abuts against the surface of the ball joint (6) on the application stick side, and a spring that biases the abutting member (7) against the ball joint (6) are provided. The application body (4) is made rotatable by allowing the shaft body (5) supporting the application body to pierce through an insertion hole (9*a*) that is provided at the tip end of the outer cylindrical member (9) and that is open in a belt shape.

Figure 9:
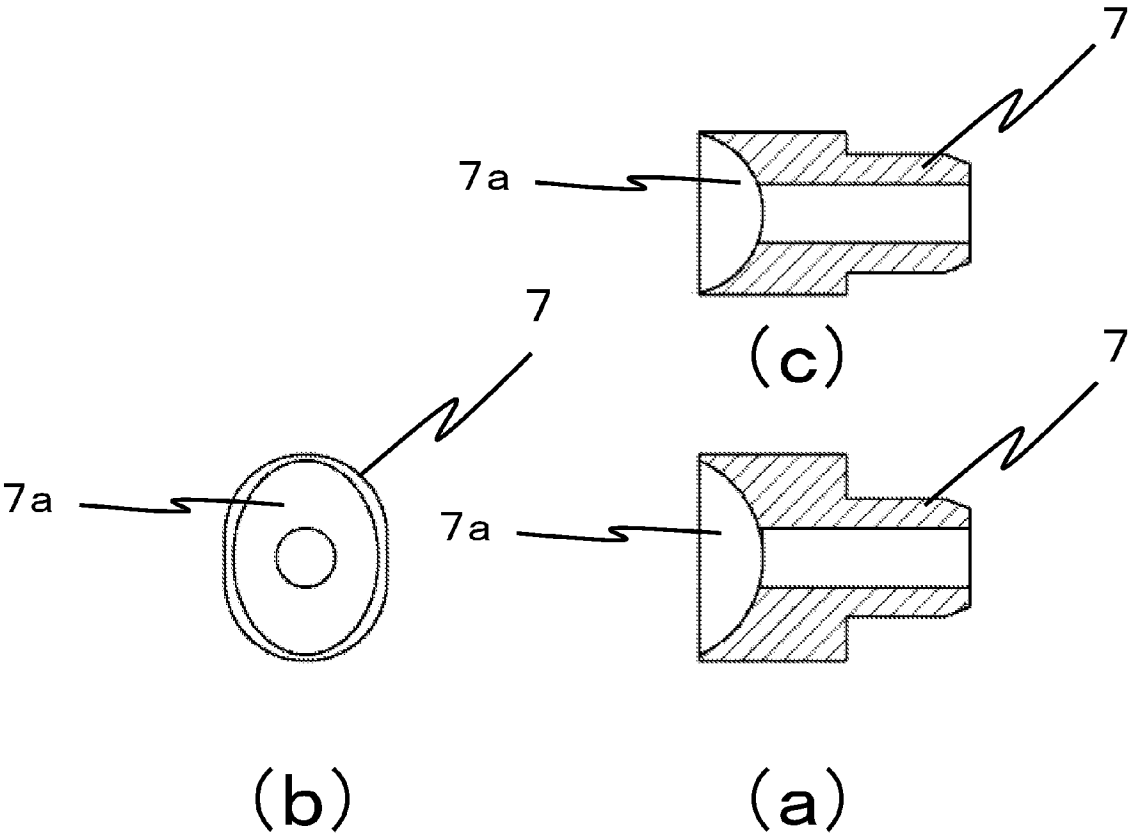
FIG. 9 is a set of enlarged views of an abutting member (FIG. 9(*a*) is a front view, FIG. 9(*b*) is a left side view, and FIG. 9(*c*) is a plan view)

The ball joint (6) is always kept and subjected to pressure contact with a constant pressure by the abutting member (7) that is biased by the spring installed inside the space (9*d*) formed between the outer cylindrical member (9) and the application stick (10), and an appropriate resistance is generated in the rotation of the ball joint (6). This makes it possible to maintain the application body (4) at an arbitrary bending angle with respect to the application stick (10). In order to increase a contact area with the ball joint, the abutting member (7) includes a curved abutting plane (7*a*) (FIG. 9).

Figure 2:
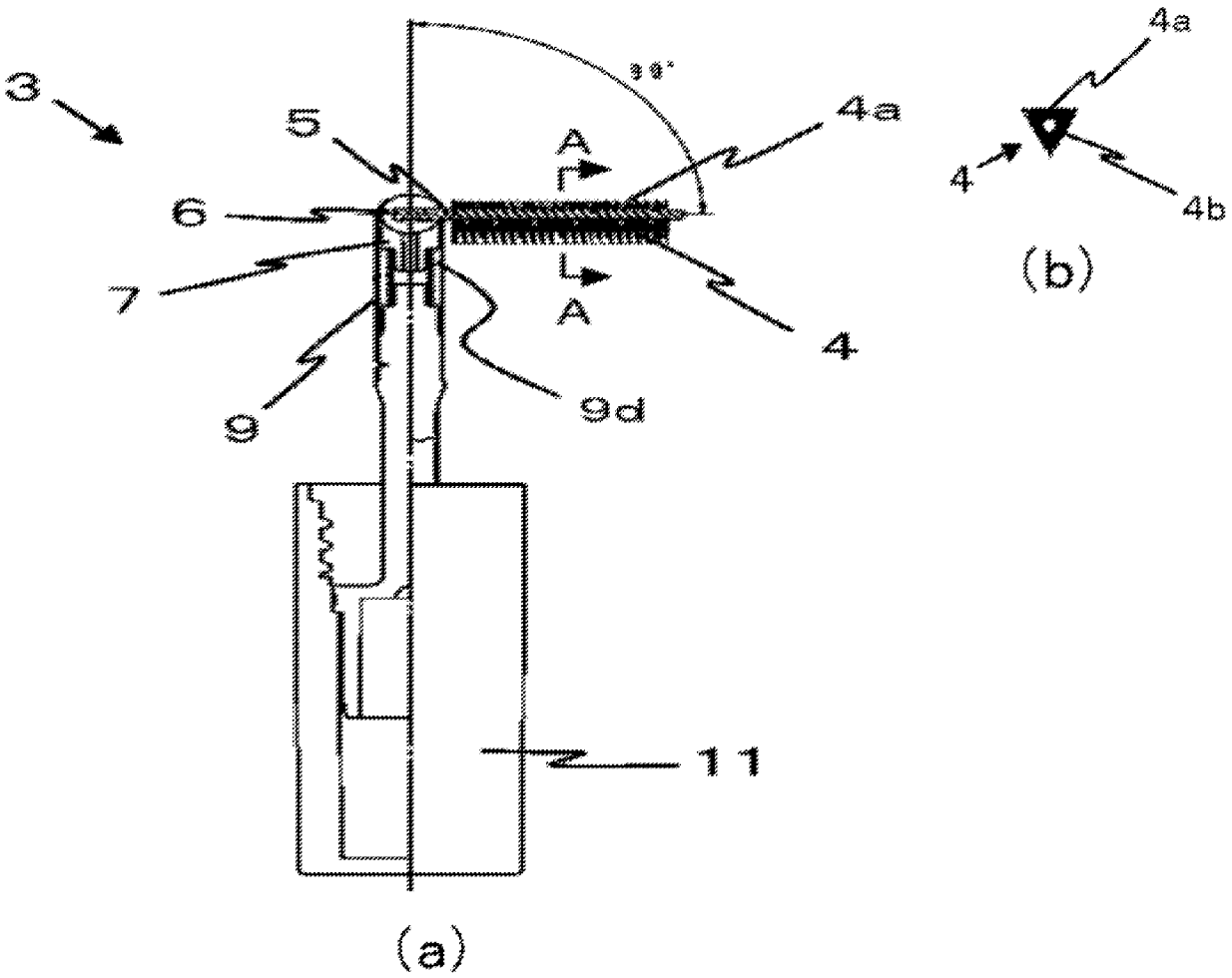
FIG. 2 illustrates a mascara applicator (partial perspective views) (FIG. 2(*a*) is an overall view of the mascara applicator, and FIG. 2(*b*) is a cross-sectional view taken along the A-A line)

The application body (4), extending in the axial direction of the shaft body (5), has a polygonal prism shape. When the application body (4) is rotated and the axis of the application body (4) is bent with respect to the axis of the application stick (10), the ball joint (6) turns so that one side surface (4*a*) of the polygonal prism, being on the side opposite to the rotating direction, becomes perpendicular to the plane passing through the two axes of the application body and the application stick (FIG. 2).

Figure 5:
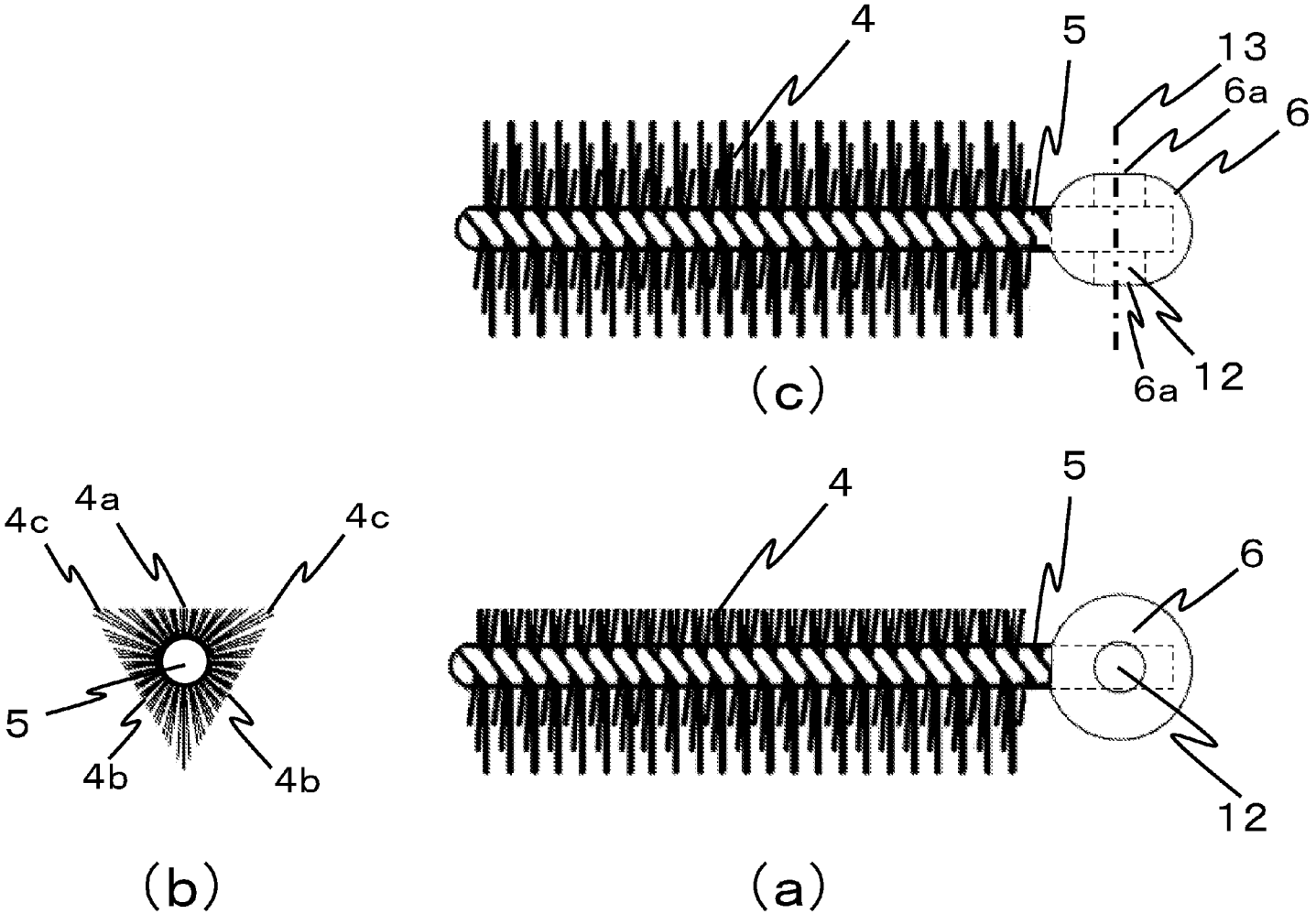
FIG. 5 is a set of enlarged views of an application body (first embodiment) (FIG. 5(*a*) is a front view, FIG. 5(*b*) is a side view, and FIG. 5(*c*) is a plan view)
Figure 8:
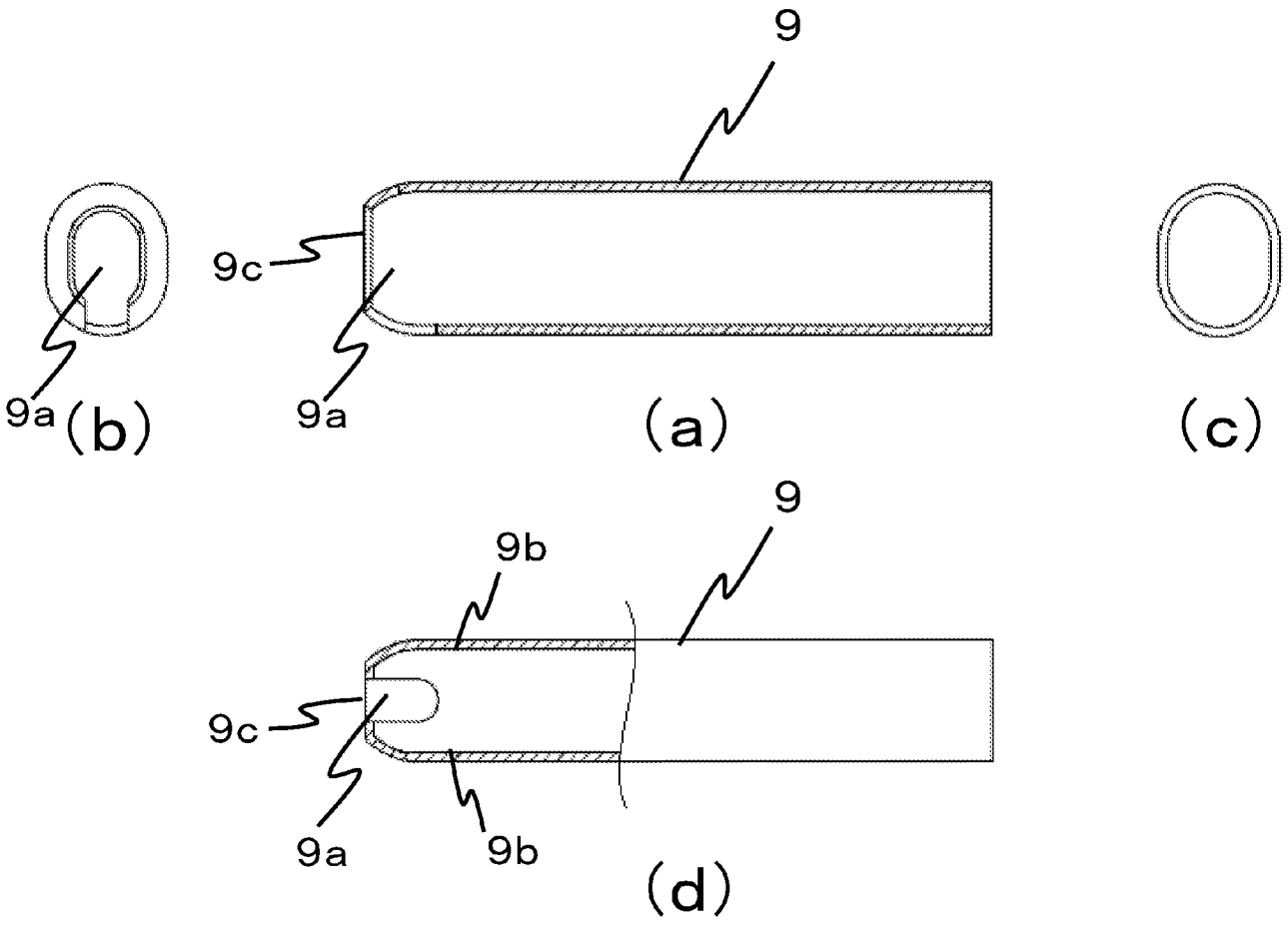
FIG. 8 is a set of enlarged views of an outer cylindrical member (FIG. 8(*a*) is a front view, FIG. 8(*b*) is a left side view, FIG. 8(*c*) is a right side view, and FIG. 8(*d*) is a plan view)

The turning direction of the ball joint (6) can be controlled by, for example, providing plane parts (6*a*, 6*a*) as illustrated in FIG. 5 that are perpendicular to the turning axis, about which the ball joint (6) turns, on the outer surface of the ball joint, and incorporating the ball joint (6) into the outer cylindrical member (9) as illustrated in FIG. 8 that is provided with plane parts (9*b*, 9*b*) capable of abutting against the plane parts (6*a*, 6*a*) on its inner surface.

Further, at a bottom (9*c*) of the outer cylindrical member (9), an insertion hole (9*a*) is provided so that the shaft body (5) moves together with the turning of the ball joint (6). The insertion hole (9*a*) has a belt shape having a notch in one direction so that the application body (4) can bend up to 90 degrees with respect to the application stick (10) (FIG. 8). The direction and the angle of the rotation of the application body (4) are controlled by the shaft body (5) moving along the insertion hole (9*a*) having the belt shape.

Figure 3:
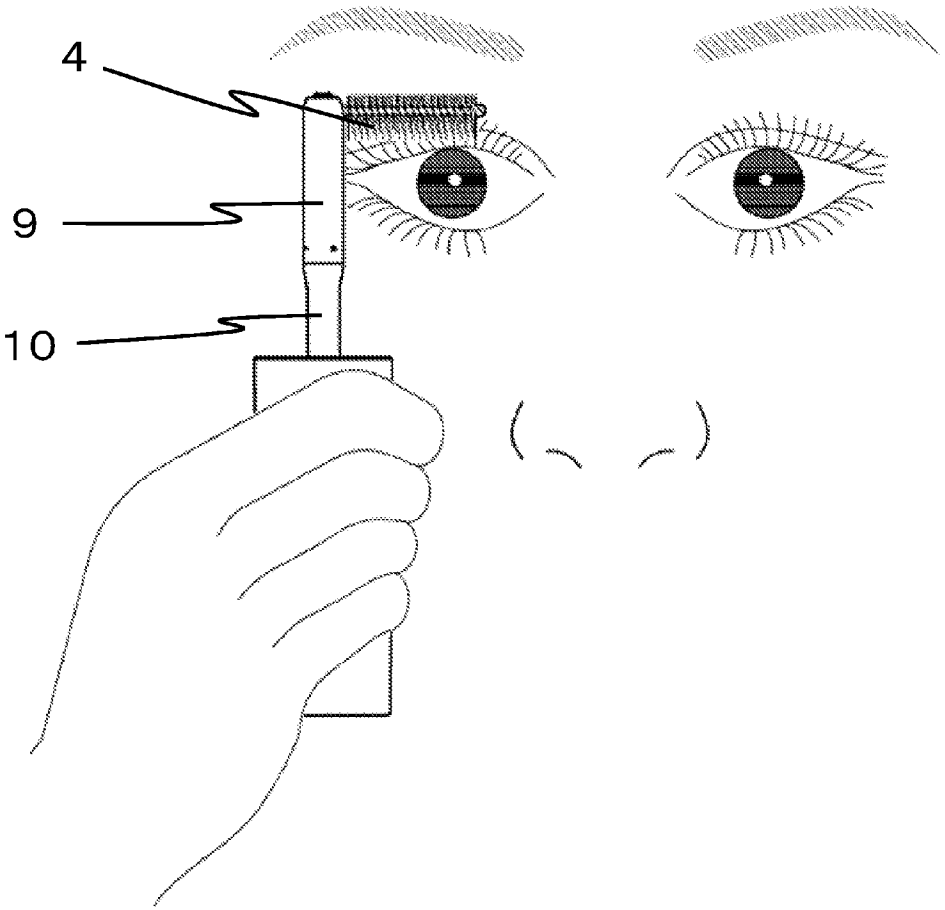
FIG. 3 is a model diagram illustrating a usage state.

Upon applying mascara on eyelashes, the cap (11) is removed from the mascara accommodation container (2), and the mascara applicator (3) is taken out of the mascara container with the mascara being stuck on the application body (4). Then, the mascara can be applied on the eyelashes by rotating the application body (4) and bending the axis of the application body (4) with respect to the axis of the application stick (10) (FIG. 3).

The application body (4) is rotated by, for example, abutting the application body (4) against the opening part (2*a*) of the mascara accommodation container (2) and applying force thereto, so that the application body (4) can be bent at an arbitrary angle required by the user. After the application of the mascara, the application body (4) may be rotated and restored to its original state for accommodation.

When the application body is bent with respect to the application stick, makeup action can be reflected in the mirror and visually recognized, contrary to the conventional case where the visual field is blocked by a shaft member of a brush or a holding hand. Therefore, it is possible to use one's dominant hand to apply the mascara on the right and left eyelashes, without the need of switching between the right and left hands for holding the brush (FIG. 3).

When the application body (4) is rotated up to 90 degrees with respect to the application stick (10), a ridge part (4*c*) that is formed by the one side surface (4*a*) of the polygonal prism of the application body, being on the side opposite to the rotating direction, and a side surface (4*b*) adjacent to the one side surface becomes perpendicular to the application stick (10). This makes it possible to apply the mascara in a stable manner while the user can keep the elbow at a lower position (FIG. 3), and to apply the mascara to the roots of the eyelashes by using the tip end of the ridge part (4*c*), so that the eyelashes can be curled effectively (FIG. 4).

Figure 4:
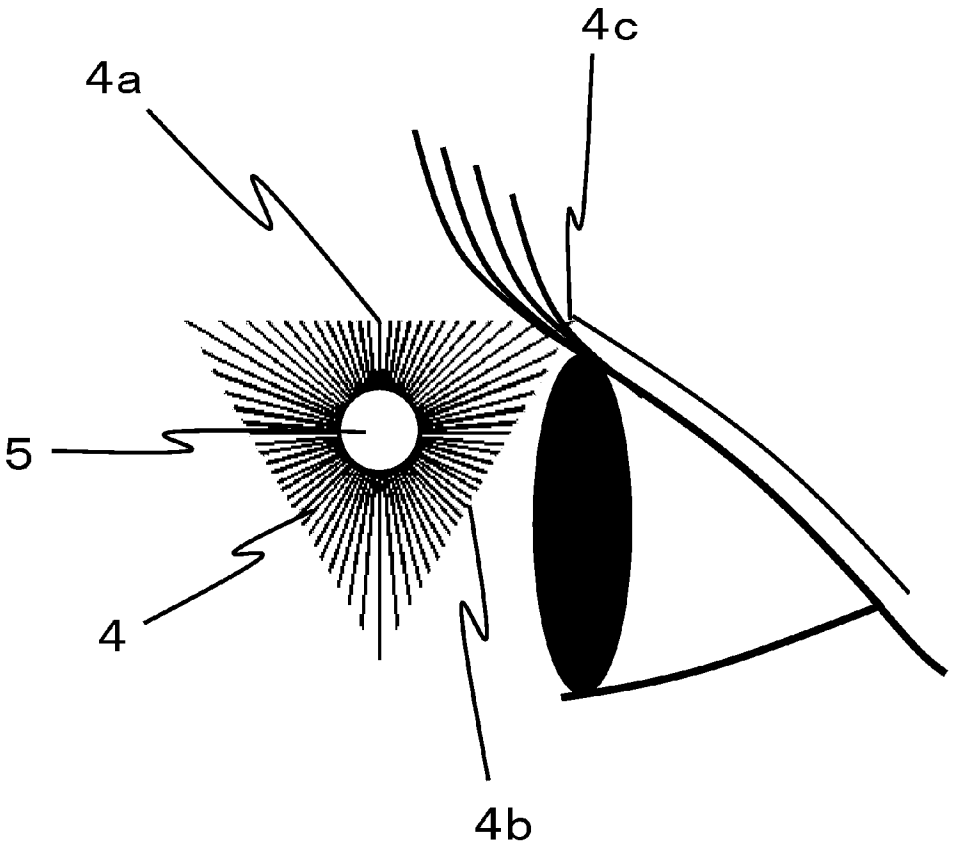
FIG. 4 is a model diagram illustrating a state of applying mascara on eyelashes.
Figure 6:
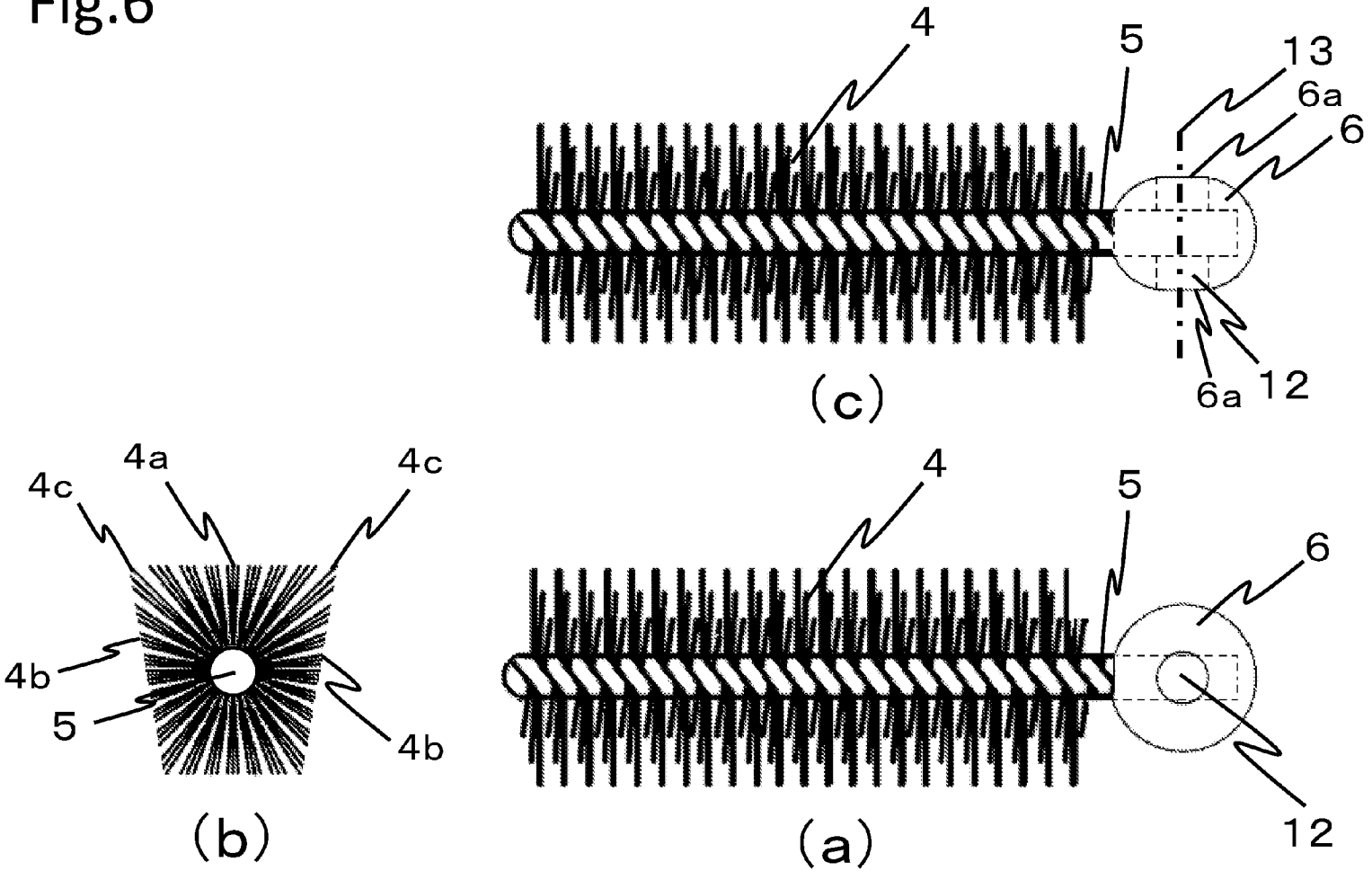
FIG. 6 is a set of enlarged views of the application body (second embodiment) (FIG. 6(*a*) is a front view, FIG. 6(*b*) is a side view, and FIG. 6(*c*) is a plan view)

When the angle made by the two side surfaces (4*a*, 4*b*) forming the ridge part (4*c*) is made as an angle acute, the mascara can be securely applied to the roots of the eyelashes (FIG. 4). When the application body has the polygonal prism shape, the shape of the polygonal prism is not particularly limited. However, it is preferable that the polygonal prism of the application body has a triangular prism shape (FIG. 5) or a quadrangular prism shape having a trapezoidal cross section (FIG. 6), because both of the two ridge parts (4*c*, 4*c*) can be made as the angle acute, and productivity thereof is excellent.

Figure 7:
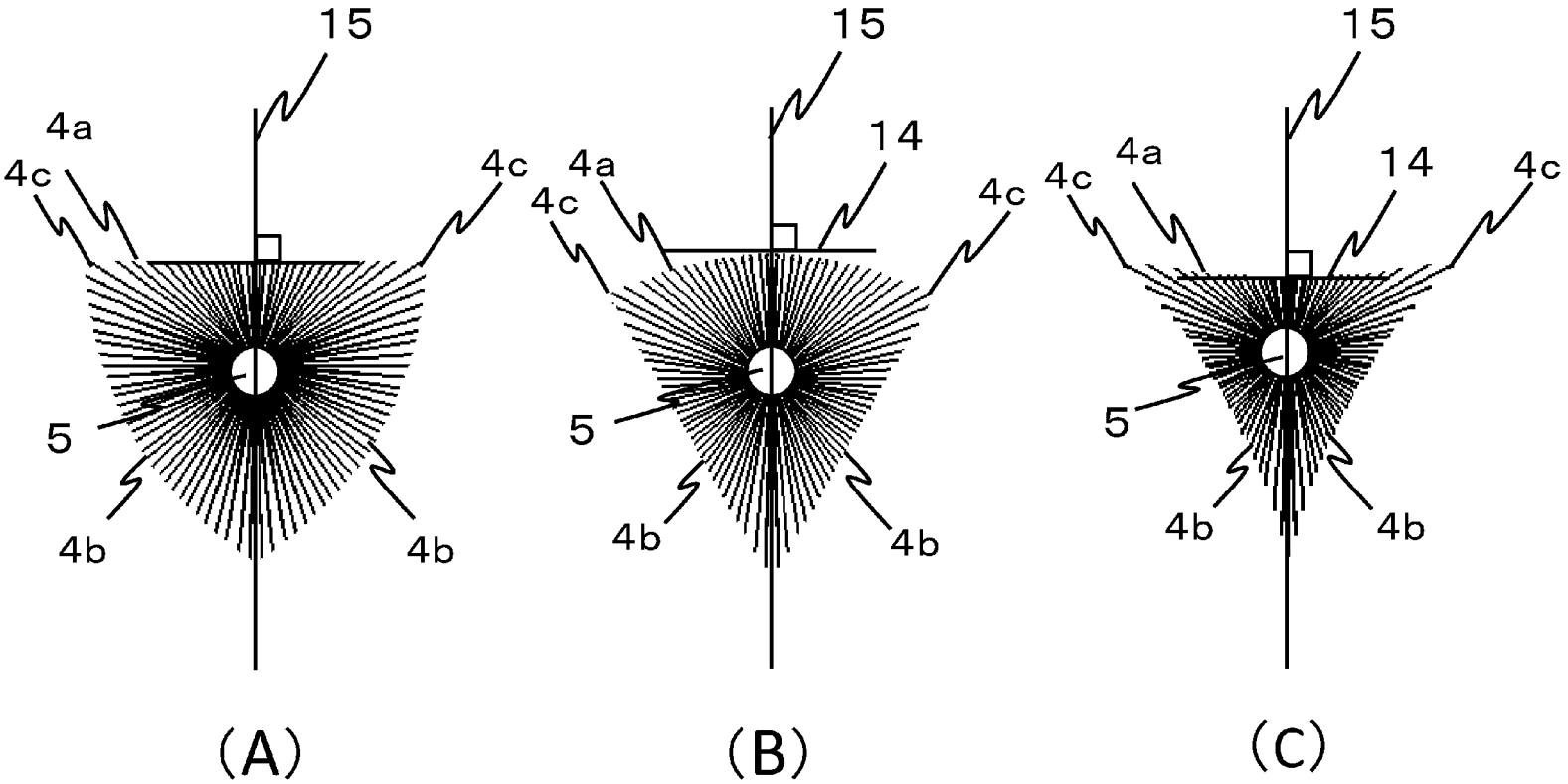
FIG. 7 is a set of cross-sectional views illustrating the shape of the application body

Further, the shape of the application body is not limited to the polygonal prism. It may be provided with a curved surface on the side surface of the application body and, as illustrated in FIG. 7, the cross section taken along the A-A line in FIG. 2(*a*) may include a curve in the outline of the cross-sectional shape. FIG. 7(A) illustrates the shape in which the side surfaces (4*b*) adjacent to the side surface (4*a*) on the side opposite to the rotating direction are convexly curved. FIG. 7(B) illustrates the shape in which the side surface (4*a*) on the side opposite to the rotating direction is convexly curved. FIG. 7(C) illustrates the shape in which the side surface (4*a*) on the side opposite to the rotating direction and the side surfaces (4*b*) adjacent to the side surface (4*a*) are concavely curved. In FIGS. 7(B) and (C), the side surfaces (4*a*) on the side opposite to the rotating direction are the curved surfaces, but the side surfaces (4*a*) and a plane (15) are orthogonal to each other because tangent planes (14) of these curved surfaces perpendicularly cross the plane (15) including a rotation path. Further, when either one (or both) of the side surfaces is the curved surface, the angle made by the two side surfaces (4*a*, 4*b*) that form the ridge part (4*c*), according to FIGS. 7(A) to (C), can be found by the angle of the tangent plane of the curved surface of the ridge part (4*c*) crossing the other side surface. Therefore, the angles made by the two side surfaces (4*a*, 4*b*) that form the ridge parts (4*c*) are the acute angles, according to FIGS. 7(A) to (C).

The application body can be formed by twisting two wires to sandwich and fix fibers, and thereafter trimming the fibers so that the cross-sectional shape perpendicular to the axial direction becomes a desired shape. Although thus-obtained application bodies (FIGS. 5 to 7) are preferable because the thin fibers get closer to the roots of the eyelashes and the mascara can be applied from the roots of the eyelashes, this is not necessarily restrictive. For example, a plurality of bristles may be integrally formed with the shaft body (5) and the plurality of bristles may form the application body, or a foamed body may be fixed to the shaft body as the application body.

Figure 10:
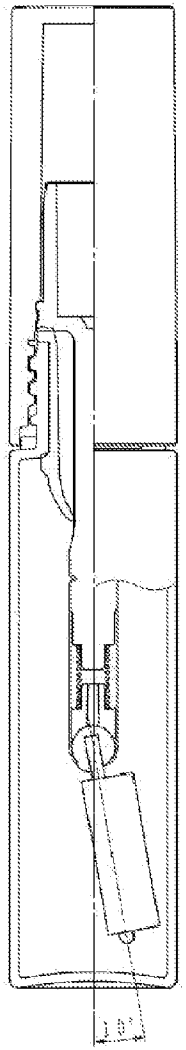
FIG. 10 is an overall view of the mascara applicator (second embodiment)

For example, the mascara applicator according to the present invention may be attached in such a manner that the axis of the application body is rotated by 10 degrees with respect to the axis of the application stick, as illustrated in FIG. 10, so that the user can instantly recognize the direction in which the application body rotates.

Embodiment

A check test conducted for checking the effect of the mascara applicator according to the present invention will be described as an embodiment.

Figure 11:
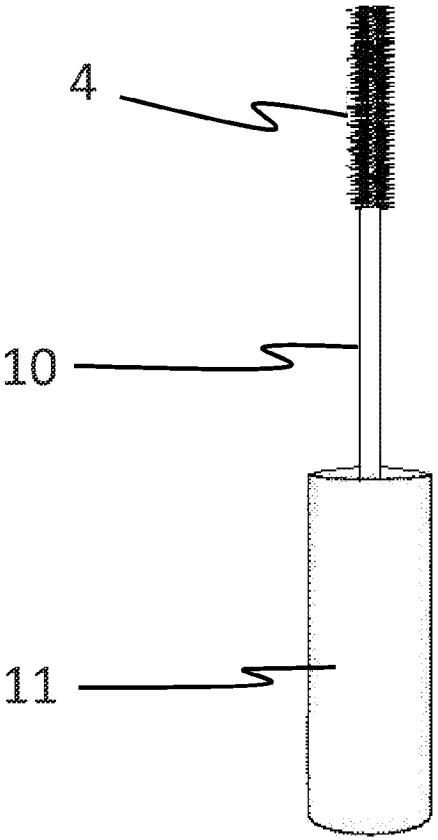
Fig.11 Prior Art
FIG. 11 is a view illustrating a conventional mascara applicator.

The check test was conducted for 20 women in their twenties to forties as panelist. The mascara applicator of the present invention (FIG. 1) and the conventional mascara applicator (FIG. 11) were used, and a survey was carried out by comparing usability and makeup finish therebetween. The mascara applicator according to the present invention includes the application body that is formed by twisting the two wires to sandwich and fix the fibers, and trimming the fibers so that the cross-sectional shape perpendicular to the axial direction becomes an inversed equilateral triangle (FIG. 5), and each of the panelists applied the mascara with the application body bent at the right angle with respect to the application stick (FIG. 3). Meanwhile, with the conventional mascara applicator, the application body that is formed by twisting the two wires to sandwich and fix the fibers, and trimming the fibers so that the cross-sectional shape perpendicular to the axial direction becomes a circle is fixed coaxially to the tip end of the application stick.

Figure 12:
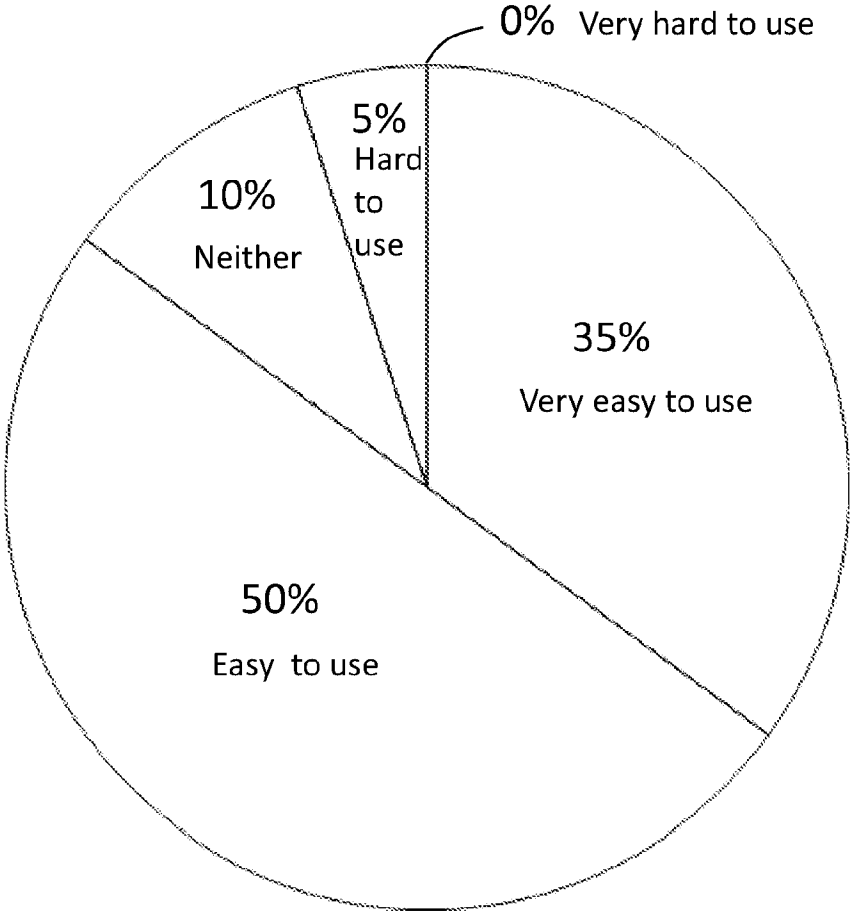
FIG. 12 is a graph illustrating the results of a survey by a check test (evaluation of usability of the mascara applicator according to the present invention)

FIG. 12 illustrates the results of the evaluation of the usability of the mascara applicator according to the present invention. 85% of the total panelists rated it as easy to use (the total of very easy to use (35%) and easy to use (50%)) because the visual field is not blocked by the hand holding the brush and the mascara can be applied in a stable manner while the user can keep the elbow at a lower position.

Figure 13:
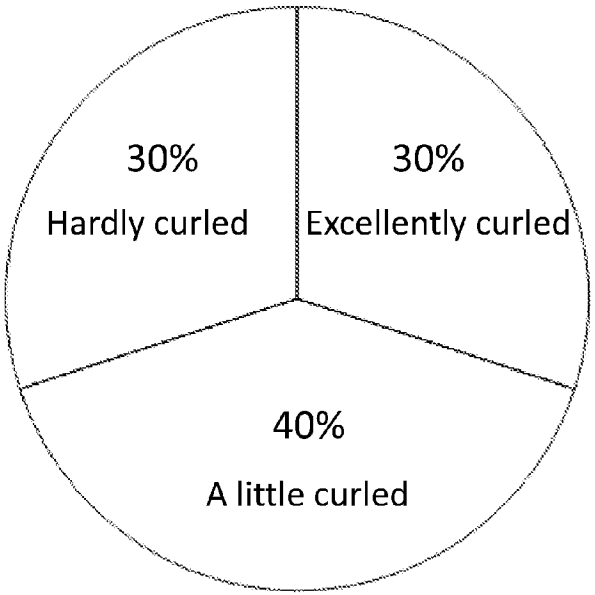
FIG. 13 is a set of graphs illustrating the results of the survey by the check test (FIG. 13(*a*) illustrates curling effect by the mascara applicator according to the present invention, and FIG. 13(*b*) illustrates curling effect by the conventional mascara applicator).
Figure 13:
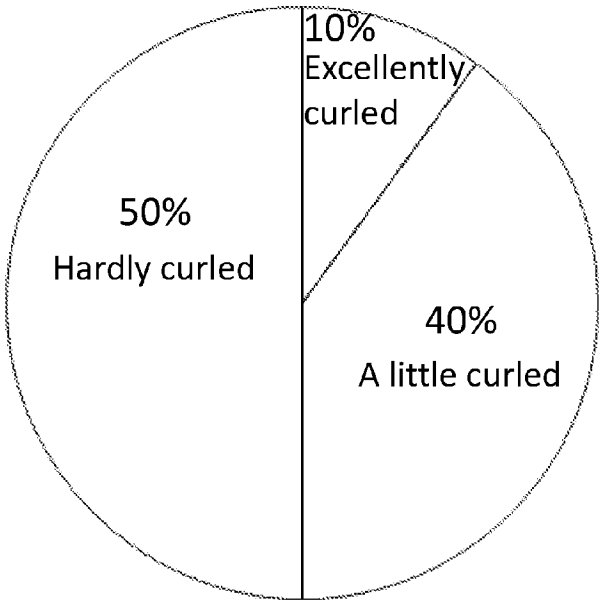

FIG. 13 shows the results of the evaluation of curling effect of the eyelashes. The percentage of the panelists who answered that the eyelashes were excellently curled was 30% with the mascara applicator according to the present invention (FIG. 13(*a*)), whereas the percentage was 10% with the conventional mascara applicator (FIG. 13(*b*)). These results demonstrate that the eyelashes were curled up effectively by applying the mascara from the roots of the eyelashes, by using the ridge part (the part illustrated as 4*c* in FIG. 4) of the mascara applicator according to the present invention.

EXPLANATION OF REFERENCE NUMERALS

1 Mascara container
2 Mascara accommodation container
2*a* Opening part
3 Mascara applicator
4 Application body
4*a* Side surface on the side opposite to rotating direction
4*b* Side surface adjacent to side surface on the side opposite to rotating direction
4*c* Ridge part
5 Shaft body

6 Ball joint
6*a* Plane part
7 Abutting member
7*a* Abutting plane against ball joint
8 Spring position
9 Outer cylindrical member
9*a* Insertion hole
9*b* Plane part
9*c* Bottom
9*d* Space
10 Application stick
11 Cap
12 Fixing pin
13 Rotation axis of application body
14 Tangent plane
15 Plane including rotation path

The invention claimed is:

1. A mascara applicator comprising:

an application stick that is attached to a cap sealing and covering an opening part of a mascara accommodation container where the application stick is capable of being accommodated in the mascara accommodation container; and an application body that is rotatably attached to a tip end of the application stick and that extends in a substantially axial direction of the application stick, wherein one side surface on a side opposite to a rotating direction of the application body is orthogonal to a plane including a rotation path, and a ridge part that is formed by the one side surface and a side surface adjacent to the one side surface is used, while the application body is rotated and an axis of the application body is bent with respect to an axis of the application stick, so as to apply mascara, wherein an outer cylindrical member is mounted at the tip end of the application stick, coaxially with the application stick, a ball joint that joins with a shaft body supporting the application body, an abutting member that abuts against a surface of the ball joint on a side proximate the application stick, and a spring provided in a space formed between an inner surface of the outer cylindrical member and an outer surface of the application stick where the spring biases the abutting member against the ball joint, and a portion of the shaft body supporting the application body is place in an insertion hole that is provided at a bottom of the outer cylindrical member, allowing the application body to be rotatable and plane parts are provided on an inner surface of the outer cylindrical member and on an outer surface of the ball joint, where the plane parts are perpendicular to a turning axis of the ball joint that turns as a result of rotation of the application body and serve to limit the rotating direction of the application body by allowing the plane parts of the outer cylindrical member and the ball joint to abut against each other.

2. The mascara applicator according to claim 1, wherein the application body is rotated and bent so that the axis of the application body and the axis of the application stick form a right angle.

3. The mascara applicator according to claim 1, wherein an angle formed by the two side surfaces that form the ridge part is an acute angle.

4. The mascara applicator according to claim 1, wherein the application body has a polygonal prism shape that extends in the substantially axial direction of the application stick.

5. The mascara applicator according to claim 1, wherein the application body has a triangular prism shape or a quadrangular prism shape that extends in the substantially axial direction of the application stick.

6. The mascara applicator according to claim 1, wherein the application body is formed by trimming fibers that are sandwiched between and fixed to a part of twisted wires, and the twisted wires, extending from the application body, are joined to the ball joint as the shaft body.

7. A makeup method comprising applying mascara in use of the ridge part of the mascara applicator according to claim 1, by rotating the application body and bending the axis of the application body with respect to the axis of the application stick.

* * * * *